US008366835B2

(12) United States Patent
Larsson

(10) Patent No.: US 8,366,835 B2
(45) Date of Patent: Feb. 5, 2013

(54) HYDRODYNAMIC NOZZLE

(75) Inventor: Bo Larsson, Kalmar (SE)

(73) Assignee: BL Consult Bo Larsson, Kalmar (SE)

( * ) Notice: Subject to any disclaimer, the term of this patent is extended or adjusted under 35 U.S.C. 154(b) by 1134 days.

(21) Appl. No.: 12/200,919

(22) Filed: Aug. 28, 2008

(65) Prior Publication Data

US 2009/0071513 A1 Mar. 19, 2009

(30) Foreign Application Priority Data

Aug. 31, 2007 (SE) ..... 0701978

(51) Int. Cl.
*B08B 13/00* (2006.01)

(52) U.S. Cl. ..... 134/166 C; 134/167 C; 134/168 C; 134/169 C; 134/171

(58) Field of Classification Search ..... 134/166 R, 134/167 R, 168 R, 169 R, 166 C, 167 C, 134/168 C, 169 C, 171
See application file for complete search history.

(56) References Cited

U.S. PATENT DOCUMENTS

| | | | | |
|---|---|---|---|---|
| 3,658,589 | A * | 4/1972 | Shaddock | 134/10 |
| 3,814,330 | A * | 6/1974 | Masters | 239/558 |
| 4,164,325 | A * | 8/1979 | Watson | 239/252 |
| 4,206,313 | A * | 6/1980 | Cavoretto | 134/167 C |
| 4,237,913 | A * | 12/1980 | Maasberg | 134/167 C |
| 4,699,163 | A * | 10/1987 | Baziuk | 134/167 C |
| 4,756,324 | A | 7/1988 | Larsson | |
| 4,923,448 | A | 5/1990 | Ennis, III | |
| 5,135,015 | A * | 8/1992 | Young | 134/179 |
| 5,383,975 | A * | 1/1995 | Faxon | 134/22.11 |
| 5,421,904 | A * | 6/1995 | Carlson | 134/22.12 |
| 5,720,309 | A | 2/1998 | Baziuk | |

(Continued)

FOREIGN PATENT DOCUMENTS

| | | |
|---|---|---|
| DE | 10321427 A1 | 3/2004 |
| GB | 1017819 | 1/1966 |

(Continued)

OTHER PUBLICATIONS

Machine Translation of JP 11-169809 to Arita, Jun. 1999.*

(Continued)

*Primary Examiner* — Michael Barr
*Assistant Examiner* — Benjamin Osterhout
(74) *Attorney, Agent, or Firm* — Pierce Atwood LLP; Kevin M. Farrell

(57) ABSTRACT

A hydrodynamic nozzle comprising a nozzle body having a first, forward end and a second, rear end, in the rear end a section-wise centrally located intake for rinsing water, internal rinsing water channels by which rinsing water is directed from the rinsing water intake to multiple rinsing water discharges mouthing in the rear end of the nozzle body in a radially outer region with respect to the rinsing water intake. The hydrodynamic nozzle has a passage for air extending through the nozzle body, said air passage connecting an air intake, mouthing in the forward end of the nozzle body, to an air discharge mouthing in the rear end of the nozzle body, wherein the air discharge is defined partly through an outer wall located radially inside the rinsing water discharges, and partly through an inner wall located radially outside the rinsing water intake.

10 Claims, 3 Drawing Sheets

U.S. PATENT DOCUMENTS

| | | | | |
|---|---|---|---|---|
| 5,992,432 | A | 11/1999 | Horger et al. | |
| 6,089,243 | A * | 7/2000 | Horger et al. | 134/167 C |
| 6,138,697 | A * | 10/2000 | Horger et al. | 134/167 C |
| 6,394,112 | B1 * | 5/2002 | Steinmetz et al. | 134/167 C |
| 2004/0040585 | A1 * | 3/2004 | Honda | 134/22.12 |

FOREIGN PATENT DOCUMENTS

JP 11169809 A * 6/1999

OTHER PUBLICATIONS

European Search Report for corresponding European application No. 08446507.9 issued Oct. 21, 2011 (4 pages).

English translation of Japanese Patent Application No. 200810213925.9 First Office Action with Examiner comments issued Feb. 29, 2012.

* cited by examiner

HYDRODYNAMIC NOZZLE

TECHNICAL FIELD OF THE INVENTION

The invention refers to a hydrodynamic nozzle of the type which is useful for rinsing the interior of a pipe, comprising a nozzle body having a first, forward end and a second, rear end, in the rear end a section-wise centrally located intake for rinsing water, internal rinsing water channels by which rinsing water is redirected from the rinsing water intake to multiple rinsing water discharges mouthing in the rear end of the nozzle body in a radially outer region with respect to the rinsing water intake, in accordance with the preamble of claim 1.

Hydrodynamic nozzles of this kind are suitable for the internal cleaning of pipes adapted for transport of surface water, waste water and sewage water, e.g. A typical use of the nozzle is the rinsing of a pipe that connects two manhole pipes or manhole wells. The nozzle is then inserted in a first, near end of the pipe, and is driven to travel to the far end of the pipe in result of the force of reaction that is generated by the pressure of the rinsing water. The nozzle is pulled back from the far end to the first near end in a working direction, against said force of reaction, while cleaning the interior of the pipe under transport of material which is released from the pipe wall by the rinsing water. The required pulling force in the operative direction is typically applied to the nozzle via a hose by which rinsing water is supplied to the nozzle, and which is connected to the rinsing water intake. The nozzle of this invention is of course useful also in applications other than the mentioned example.

BACKGROUND AND PRIOR ART

Hydrodynamic nozzles of this general type are previously known. In U.S. Pat. No. 4,756,324 B1 and U.S. Pat. No. 5,992,432 B1, e.g., different hydrodynamic nozzles readable on the preamble of claim 1 are shown. These known nozzles both comprise a substantially homogenous nozzle body with a rotationally symmetric exterior. Embodiments include a channel extending centrally through the nozzle body to mouth in that end of the nozzle which is opposite from the end in which rinsing water is supplied to the nozzle. The channel is connected to the rinsing water intake and arranged for discharge of rinsing water in the direction of movement as the nozzle travels towards the far end of the pipe to be cleaned.

Another hydrodynamic nozzle is previously known from U.S. Pat. No. 3,814,330 B1, operating in a similar way. This nozzle however differs from the above mentioned nozzles in that, inter alia, it has a section-wise substantially cruciform nozzle body. From a central portion to an imaginary periphery connecting the outer ends of adjacent arms, the nozzle body is outwards open between the arms of the cross. This way there is formed a cross-section having substantially quarter-circular passages along the nozzle body, which passages are outwardly non-restricted in the radial direction. The purpose of the passages is explained to allow for transport of detached material along the nozzle body as the nozzle travels towards the far end of the pipe to be cleaned.

The transport of detached material in the operative direction is a power consuming work that employs a portion of the energy supplied with the rinsing water, and thus also consumes a portion of the cleaning capacity of the nozzle. This problem is not discussed or solved in known designs of hydrodynamic nozzles.

SUMMARY OF THE INVENTION

The object of the invention is to provide a hydrodynamic nozzle having improved cleaning capacity.

Another object is to provide a hydrodynamic nozzle achieving reduced consumption of rinsing water and correspondingly reduced power consumption.

These objects are achieved in a hydrodynamic nozzle as specified in the characterizing portion of claim 1.

Briefly, the present invention provides a hydrodynamic nozzle of the type explained by way of introduction, wherein an air passage extending through the nozzle body is shaped for the passage of air, the passage connecting an air intake, mouthing in the forward end of the nozzle, with an air discharge mouthing in the rear end of the nozzle, wherein the air discharge is defined, partly through an outer wall located radially inside the rinsing water discharges, and partly through an inner wall located radially outside the rinsing water intake.

In a preferred embodiment, the nozzle comprises a rotationally symmetric exterior of the nozzle body, having angularly equally spaced rinsing water discharges distributed in a ring surrounding the air passage mouthing radially inside the rinsing water discharges, the air discharge this way arranged for discharge of air passing through, between and in concentric relation with the rinsing water intake and the rinsing water discharges, respectively.

Advantageously, the air passage can be formed to have a continuous ring-shaped cross-section, at least for a portion of its length from the air intake to the air discharge. The length of continuous, ring-shaped section may be located in the air intake, and/or in the air discharge, and/or in a length of the air passage located between said parts of the air passage.

In another embodiment the air passage may be divided in two or more sub-passages, at least for a portion of its length between the air intake and the air discharge, said sub-passages each having the cross-sectional shape of a ring segment. The ring-segmented length may be located in the air intake and/or in the air discharge, and/or in a length of the air passage located between said parts of the air passage.

The air passage advantageously has a length of reduced cross-sectional area upstream of the air discharge. Specifically, the air discharge as seen in an axial section view may have the shape of a deLaval nozzle. The air passage may also be formed to have a sectional area increasing towards the air intake.

SHORT DESCRIPTION OF THE DRAWINGS

The invention is more closely explained below in connection with the attached drawings, schematically illustrating embodiments of the invention and wherein FIG. 1 is a perspective view of an embodiment of a hydrodynamic nozzle according the invention;

DETAILED DESCRIPTION OF EMBODIMENTS OF THE INVENTION

Figure 1:
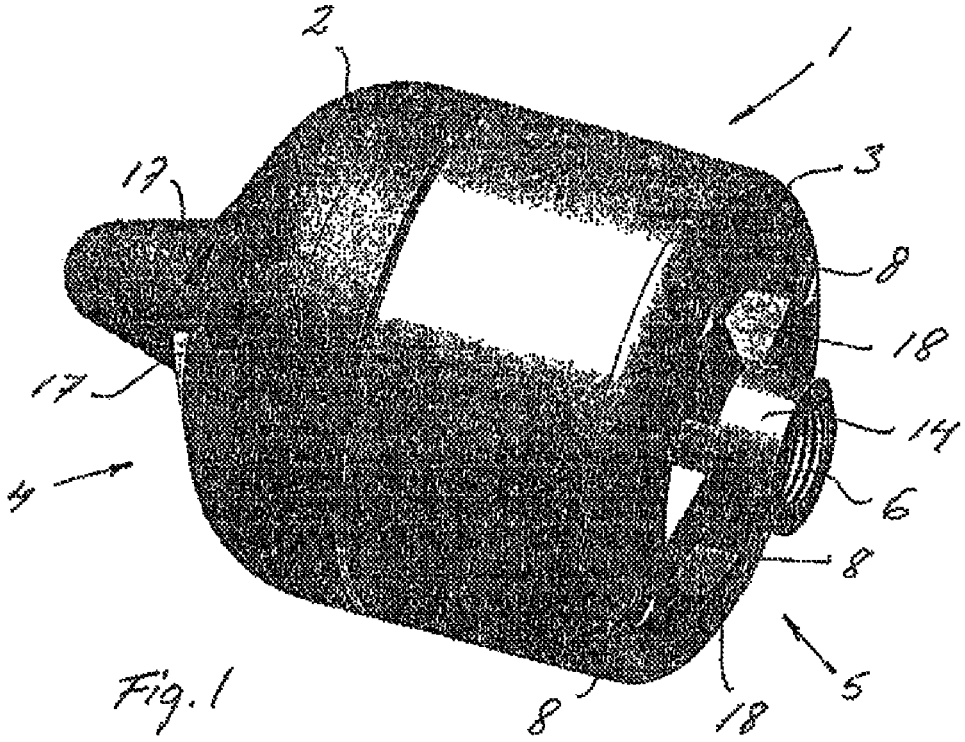
Figure 2:
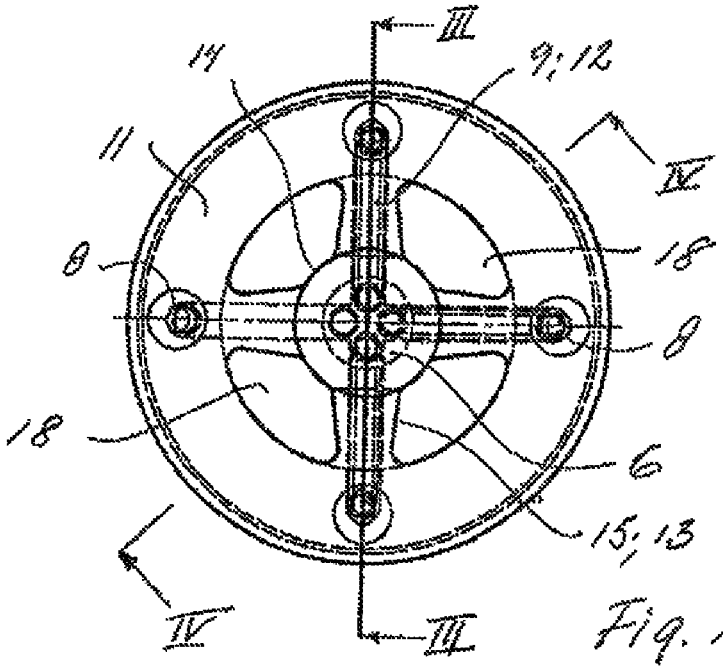
FIG. 2 shows a rear end of the nozzle of FIG. 1.

By way of introduction it shall be explained that the forward end of the nozzle shall be understood as referring to the leading end of the nozzle when the nozzle is moved forward driven by the force of reaction generated by the pressure of the rinsing water, whereas the rear end refers to the trailing end during said motion.

With reference to FIGS. 1-5, the nozzle comprises a nozzle body 1 typically made from metal. For reason of manufacture, the body 1 may be composed of a forward body part 2 and a rear body part 3. The nozzle body 1 reaches from a forward end 4 to a rear end 5. Located centrally in the nozzle body is an intake 6 for rinsing water, mouthing in the rear end 5. The rinsing water intake 6 is conventionally arranged for connection to a hose by which rinsing water is supplied to the nozzle body 1, at a pressure which may amount to the order of, e.g., 50-60 bar (5000-6000 kPa). Naturally, other pressures may apply and the present invention shall not be understood as restricted to the stated pressure interval. Multiple rinsing water channels 7 are arranged in the nozzle body 1 to guide rinsing water from the rinsing water intake 6 to multiple rinsing water discharges 8. The rinsing water discharges 8 mouth in the rear end 5 of the nozzle body, and in a radially outer region of the nozzle body 1 with respect to the rinsing water intake 6. Without being illustrated in the drawings it shall be mentioned, for reason of complete description, that the discharges 8 may be arranged for detachably mounting of replaceable nozzles. Such nozzles are typically angled outwards from the axial centre of the nozzle body in order to direct rinsing water towards the interior wall of the pipe to be cleaned. The nozzles may also have a tangential component of direction, if appropriate, in order to generate or in order to counteract a rotation of the nozzle body about its longitudinal centre.

The nozzle body 1 of the illustrated embodiment comprises a rotationally symmetric outer shape, having four angularly equally distanced rinsing water discharges 8 distributed in a cross-sectional view. Other embodiments are conceivable. For example, the nozzle body may have a polygonal cross section, and the number of rinsing water discharges may in the alternative be more or less than four.

As explained above, the nozzle body 1 is structured to reverse the direction of supplied rinsing water by means of correspondingly shaped rinsing water channels. Because the discharge flow of rinsing water, as conventional per se, is re-directed and opposite the intake flow, a force of reaction is generated which results in the forward motion of the nozzle body towards the far end of the pipe to be cleaned.

Figure 3:
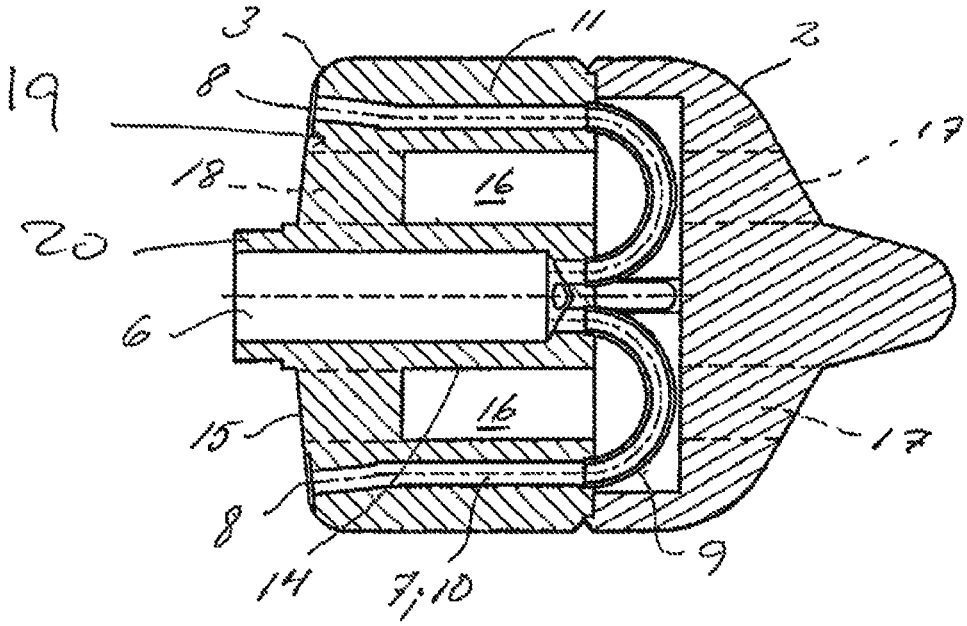
FIG. 3 shows a length section through the axial centre of the nozzle of FIGS. 1 and 2.
Figure 4:
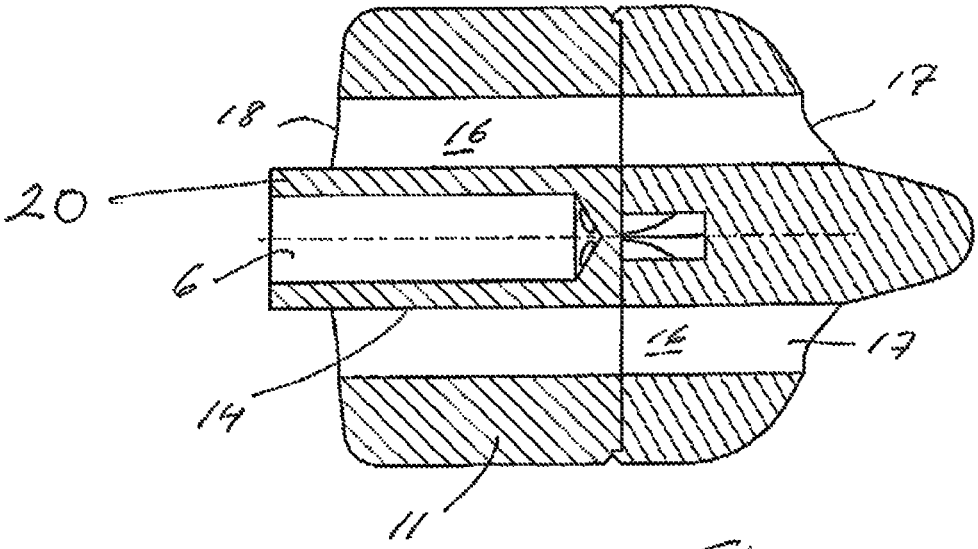
FIG. 4 shows a length section similar to FIG. 3 and rotated 45° (about the axial centre) with respect to the sectional view of FIG. 3.
Figure 5:
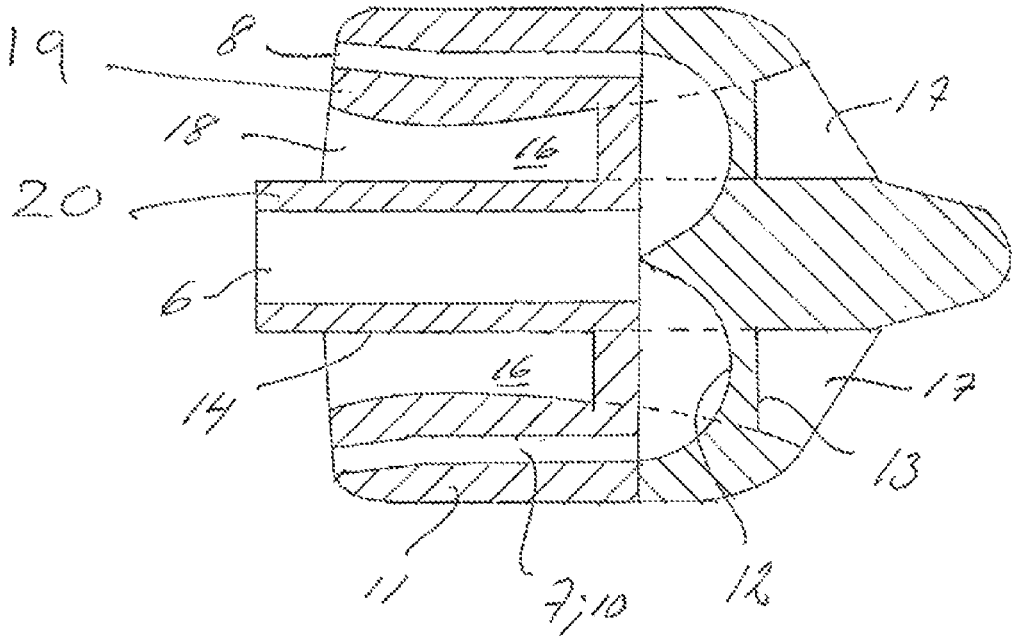
FIG. 5 shows a length section through a second embodiment of a hydrodynamic nozzle according to the invention.

The detailed structure of the rinsing water channels per se is not of crucial importance for the present invention. An important feature is however that those length portions of the rinsing water channels 7 which connect, in radial directions, the rinsing water intake 6 to the rinsing water discharges 8, are housed in a region of the nozzle body which comprises portions that are open end free from material, when seen in a cross-sectional view. This can be realized as illustrated in FIG. 3, wherein the rinsing water channels 7 include bended, discrete tubes 9 that reach from the rinsing water intake 6 and which continue in rinsing water channel lengths 10 that are formed in a surrounding wall 11, forming part of the nozzle body 1. Alternatively, the rinsing water channels 7 may comprise cup-shaped recesses 12 as illustrated in FIG. 5, and which in a corresponding way are arranged for connecting the rinsing water intake 6 to the rinsing water discharges 8, via the rinsing water channel lengths 10. In the later embodiment at least, it may be appropriate to arrange the radial rinsing water channel lengths in individual legs 13, which connect in radial directions a central region 14 of the nozzle body with the surrounding wall 11.

From the above it will be realized that the nozzle body 1 comprises a central region 14 wherein the rinsing water 6 is located, and a surrounding wall 11 in which the rinsing water discharges 8 are located. A number of arms 15, 13 reach in radial direction from the central region 14 to the wall 11, in such way that between the wall and the central region there is formed a substantially concentric space. The connecting arms are preferably equally angularly spaced in a sectional view. The space formed this way acts as a passage 16 for air passing through the nozzle body 1.

The air passage 16 connects an air intake 17, mouthing in the forward end of the nozzle body, with an air discharge 18 mouthing in the rear end of the nozzle body. The air passage 16 is confined to the space defined between the central region 14 and the surrounding wall 11 of the nozzle body. Through the inner periphery of the wall 11, the air discharge 18 is defined by an outer limitation 19 (e.g., outer wall) running radially inside the rinsing water discharges 8. Through the outer periphery of the central region 14, the air discharge 18 is additionally defined by an inner limitation 20 (e.g., inner wall) running radially outside the rinsing water intake 6.

In the rotationally symmetric nozzle body 1 of the illustrated embodiment, wherein the rinsing water discharges 8 are arranged on a ring surrounding the rinsing water intake 6, the air discharge 18 is thus shaped for discharge of air passing through between and in concentric relation with the rinsing water intake and the ring of rinsing water discharges, respectively.

From the above it will also be realized that the air passage 16, in at least a portion of its length from the air intake 17 to the air discharge 18, has a continuous ring-shaped sectional area. In the embodiment of FIGS. 1-4, a continuous ring-shaped portion of the length of the air passage 16 is formed in a middle region of the air passage, whereas in the embodiment illustrated in FIG. 5 the continuous ring-shaped portion of the length is located in the regions of the air intake and the air discharge, respectively.

From the above description and from the drawings it is also realized that the air passage 16, in at least a portion of its length from the air intake to the air discharge, is divided into two or more sub-passages, wherein each sub-passage comprises the sectional view of a ring segment. In the embodiment of FIG. 5, a ring segment shaped portion of the air passage 16 is located to a middle region of the air passage, whereas in the embodiment of FIGS. 1-4 the ring segment shaped portion is located to the regions of the air intake and/or the air discharge, respectively.

The passage 16 for through passage of air may be designed to influence the aerodynamic conditions within the passage, aiming for increasing the flow and/or the flow rate of air passing through the nozzle body. In the axial section view of FIG. 5 it is illustrated how the passage 16 in a region upstream of the air discharge 18 may include a region of reduced flow area. This region can be formed to give the air discharge the shape of a discharge nozzle, such as a deLaval nozzle. For a similar purpose, the passage 16 may be formed to have a flow area increasing towards the air intake 17, this way allowing for a larger intake volume.

By providing, as described above and in illustrated embodiments, a passage of air through the nozzle body it is achieved that the cleaning capacity of the nozzle is increased. In result of the pressure and flow rate of rinsing water discharged from the rinsing water discharges 8, a reduction of pressure in the air is achieved at the rear end of the nozzle. By confining the discharges 18 of the air passage so as to mouth radially inside the rinsing water discharges there is achieved, by reduced pressure, a certain ejector effect which accelerates the air flow through the air passage 16 and the passage discharges 18. The concentrated air flow supports the transport of detached material in the operative direction, i.e. towards the first and near end of the pipe to be cleaned. The concentrated air flow results in increased capacity of the nozzle, which can alternatively be used for reduction of rinsing water volumes and thus for reduction of the energy that needs to be supplied in the procedure of cleaning the interior of pipes.

Modification of details in the structure of illustrated embodiments is of course possible without departing from the scope of invention as specified in the appended claims.

The invention claimed is:

1. A hydrodynamic nozzle, of the type which is useful for rinsing the interior of a pipe, comprising a nozzle body (1) having a first, forward end and a second, rear end, in the rear end a section-wise centrally located intake (6) for rinsing water, internal rinsing water channels by which rinsing water is redirected from the rinsing water intake (6) to multiple rinsing water discharges (8) mouthing in the rear end of the nozzle body in a radially outer region with respect to the rinsing water intake, characterized by a passage (16) for air extending through the nozzle body, said air passage (16) connecting an air intake (17), mouthing in the forward end of the nozzle body, to an air discharge (18) mouthing in the rear end of the nozzle body, wherein the air discharge (18) is defined, partly through an outer wall located radially inside the rinsing water discharges (8), and partly through an inner wall located radially outside the rinsing water intake (6), and configured to discharge air.

2. The nozzle of claim 1, characterized by a rotationally symmetric nozzle body (1) wherein the rinsing water discharges (8) are equally angularly spaced on a ring surrounding the air passage (16) which mouths radially inside the rinsing water discharges (8), and wherein the air discharge (18) is arranged for discharge of air passing through, between and in concentric relation with the rinsing water intake (6) and the rinsing water discharge (8), respectively.

3. The nozzle of claim 1 or claim 2, characterized in that the air passage (16) has a continuous ring-shaped cross section at least in a portion of its length between the air intake (17) and the air discharge (18).

4. The nozzle claim 1 or 2, characterized in that the air discharge (18) is continuously ring-shaped.

5. The nozzle of claim 1, characterized in that the air intake (17) is continuously ring-shaped.

6. The nozzle of claim 1, characterized in that the air passage (16) for at least a portion of its length between the air intake (17) to the air discharge (18) is divided into two or more sub-passages, wherein each sub-passage comprises the cross-sectional shape of a ring segment.

7. The nozzle of claim 6, characterized in that the air discharge (18) has the cross-sectional shape of a ring segment.

8. The nozzle of claim 6 or claim 7, characterized in that the air intake (17) has the cross-sectional shape of a ring segment.

9. The nozzle of claim 1, characterized in that the air passage (16) comprises a region of reduced cross sectional area upstream of the air discharge (18).

10. The nozzle of claim 1, characterized in that the air passage (16) comprises a cross-sectional area which increases towards the air intake (17).

* * * * *